United States Patent [19]

Smith et al.

[11] Patent Number: 4,708,570

[45] Date of Patent: Nov. 24, 1987

[54] UNIVERSAL CONTAINER GRABBER APPARATUS FOR A REFUSE COLLECTION VEHICLE

[75] Inventors: Fred T. Smith, Palos Verdes Penninsula; Fred P. Smith, Lomita, both of Calif.

[73] Assignee: The Heil Co., Milwaukee, Wis.

[21] Appl. No.: 750,138

[22] Filed: Jul. 1, 1985

[51] Int. Cl.[4] ..... B65F 3/06; B66C 3/16

[52] U.S. Cl. ..... 414/408; 414/621; 294/106; 294/114

[58] Field of Search ..... 414/408, 409, 619, 620, 414/621, 739, 783, 428, 450, 452, DIG. 911; 294/104, 106, 114; 901/31, 39

[56] References Cited

U.S. PATENT DOCUMENTS

| | | | |
|---|---|---|---|
| 3,165,348 | 1/1965 | Keskitalo | 414/621 |
| 3,580,099 | 5/1971 | Mosher | 901/39 |
| 3,972,431 | 8/1976 | Fischer | 294/106 |
| 4,005,894 | 2/1977 | Tucek | 294/88 |
| 4,401,407 | 8/1983 | Breckenridge | 414/408 |

FOREIGN PATENT DOCUMENTS

| | | | |
|---|---|---|---|
| 189258 | 5/1964 | Sweden | 294/104 |

*Primary Examiner*—Lawrence J. Oresky

*Attorney, Agent, or Firm*—Fuller, Puerner & Hohenfeldt

[57] ABSTRACT

Apparatus for use in grabbing a refuse container such that the container can be emptied into a refuse collection truck. The grabbing apparatus includes a pair of opposed articulated grabbing arms which have the capability of securely grabbing containers of substantially different sizes without crushing or otherwise damaging those containers.

23 Claims, 6 Drawing Figures

UNIVERSAL CONTAINER GRABBER APPARATUS FOR A REFUSE COLLECTION VEHICLE

FIELD OF THE INVENTION

The present invention relates to mechanical grasping devices and more particularly to apparatus for use in grabbing and conveying containers of the type for use in handling solid waste refuse materials or municipal refuse.

BACKGROUND PRIOR ART

Trucks for use in collecting municipal solid waste refuse commonly include a grasping device for grabbing a container. The grasping device is mounted on a lift frame or swingable arm such that the container can be raised and dumped into the truck. Containers commonly range in size from 90 gallons to 400 gallons. The grabbing apparatus must firmly grip the container such that the container will be not dropped when it is lifted, yet the grabbing apparatus should not crush the container. In many of the prior structures, the grasping device will include a pair of opposed arms hydraulically and pivotally movable into grabbing engagement with the selected container. The grabbing arms have a configuration such that they can accommodate containers of certain sizes and shapes. Handling containers of different sizes requires the operator to move one set of grabbing arms and replace them with a second set of grabbing arms.

It is common in the prior art arrangements that the refuse truck will carry different sets of grabbing arms for different sized containers encountered on a collection route. Containers to be emptied may be 90 gallon containers, 150 gallon containers, 400 gallon containers, etc. If an operator has grabbers for lifting 90 gallon containers supported by the lift arm, and then encounters a 400 gallon container, it is necessary for the operator to get out of the cab, remove the 90 gallon grabbers, secure the 90 gallon grabbers to a storage bracket, remove two 400 gallon grabbers from a similar bracket and mount the 400 gallon grabbers on the lift boom. The grabbers are commonly difficult to install, and the larger grabbers can be quite heavy.

Municipalities commonly attempt to design their collection routes so that exchange of grabbers of different sizes is minimized, but planning the collection routes based on the size of the containers can result in inefficient routes.

One prior art attempt to design an apparatus functional to grasp refuse containers of various sizes is illustrated in the Breckenridge U.S. Pat. No. 4,401,407, issued Aug. 30, 1983.

SUMMARY OF THE INVENTION

The present invention provides an improved grabbing apparatus for use in grabbing a container such that the container can be emptied into a truck. The grabbing apparatus includes a pair of articulated grabbing arms having the capability of securely grabbing containers of substantially different sizes without crushing or otherwise damaging those containers.

The container grabbing apparatus is adapted to be mounted on the end of a swingable boom of a refuse collection truck such that a container engaged by the grabbing apparatus can be emptied into the refuse collection truck. The grabbing apparatus includes a base portion adapted to engage the container, a first articulated grabbing arm adapted to extend around one side of the container, and a second articulated grabbing arm adapted to extend around an opposite side of the container, the articulated grabbing arms being constructed to force the container against a base portion of the grabbing apparatus. The first articulated grabbing arm includes a pair of arm sections hingedly joined together. One of the arm sections is pivotally carried by the base, and the second arm section is pivotally connected to the free end of the first arm section. A link extends between the base and the second arm section and is pivotally connected to the second arm section intermediate the opposite ends of the second arm section such that during movement of the first articulated grabbing arm between the retracted position and a grabbing position, the second arm section is caused to pivot with respect to the first arm section. A second articulated grabbing arm similarly includes a pair of arm sections pivotally joined together. A first arm section is connected to the base, and the second arm section is pivotally connected to the first arm section. A link extends between the base and the second arm section and is pivotally connected to that second arm section intermediate its opposite ends and such that as the second articulated arm moves from a retracted position to a grabbing position, the second arm section pivots with respect to the first arm section.

A hydraulic cylinder is also provided for causing movement of the articulated arms between the retracted position and the container grabbing position. The hydraulic cylinder has one end pivotally connected to the base and an opposite end connected to one of the first arm sections. A connecting link has one end pivotally connected to one of the first arm sections and an opposite end pivotally connected to the other of the first arm sections such that as the hydraulic cylinder causes movement of one of the first arm sections from a retracted position to a grabbing position, the connecting link will cause movement of the other of the first arm sections from a retracted position to a grabbing position.

One of the principal advantages of the articulated grabbing arms of the present invention is that they can securely grip containers of various sizes and maintain control of these containers during the dumping process without applying unnecessary grabbing force on the containers or otherwise deforming or crushing the containers. The articulated grabbing arms of the invention can be used to empty containers having a four hundred gallon capacity as well as containers having a ninety gallon capacity, and the vehicle operator is not required to substitute one set of grabbing arms for another in order to empty containers of such different sizes.

Another advantage of the structure of the grabbing apparatus embodying the invention is that the articulated arms surround the container, and when grabbing a large container, they force the container against the base member or lift frame. This provides better container control than is achieved with prior art arrangements used for lifting large containers.

Another feature of the articulated arms of the grabbing structure is that when grabbing a smaller container, the sections of the articulated grabbing arms continue to move inwardly with the ends of the opposed articulated arms overlapping one another. The contours of the individual sections provide five areas of contact where the arms engage the container, these areas of contact being spaced substantially uniformly around the circumference of the containers. In these areas, the surface configurations of the arms are complementary to the surface of the container. This arrangement also provides good control over the smaller containers.

Another advantage of the invention is that the articulated arms can be positioned such that they can surround and grip a container even if that container is positioned closely to other containers or structures.

Another feature of the invention is that the clamping force of the cylinder is distributed substantially uniformly to the articulated sections of the grabbing arms, and the force applied by the individual sections against the container is substantially the same.

Various other features and advantages of the invention will be apparent by reference to the following description of a preferred embodiment, from the claims and from the drawings.

Figure 1:
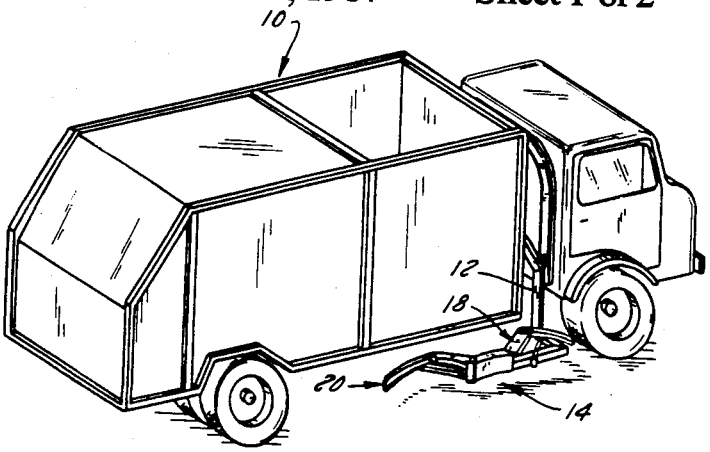
FIG. 1 is a perspective view of a refuse collection truck including a container grabbing assembly embodying the invention.

Before explaining the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a refuse collection truck 10 including apparatus embodying the invention and for use in emptying refuse containers into the refuse collection truck. In the illustrated arrangement the refuse collection truck 10 is of the type constructed to receive municipal refuse dropped into the top of the truck, and the truck includes a movable boom or lift frame 12 for lifting and dumping a refuse container 13 of the type shown in FIG. 3. As is conventional, the illustrated lift frame 12 has one end pivotally supported by the truck frame and an opposite end supporting a grasping apparatus or grabbing assembly 14. A hydraulic cylinder (not shown) is provided in a conventional manner for causing selective movement of the lift frame 12 between a container grabbing position and a raised container dumping position. While in the illustrated arrangement the lift frame 12 is supported for side loading refuse collection vehicles, the present invention is also applicable to rear loading refuse trucks wherein the containers to be dumped are at the rear of the truck rather than being at the side of the truck.

Figure 2:
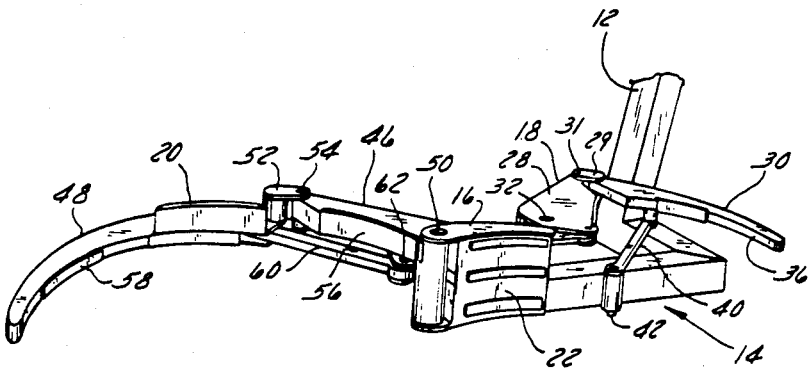
FIG. 2 is an enlarged perspective view of the container grabbing assembly illustrated in FIG. 1.
Figure 3:
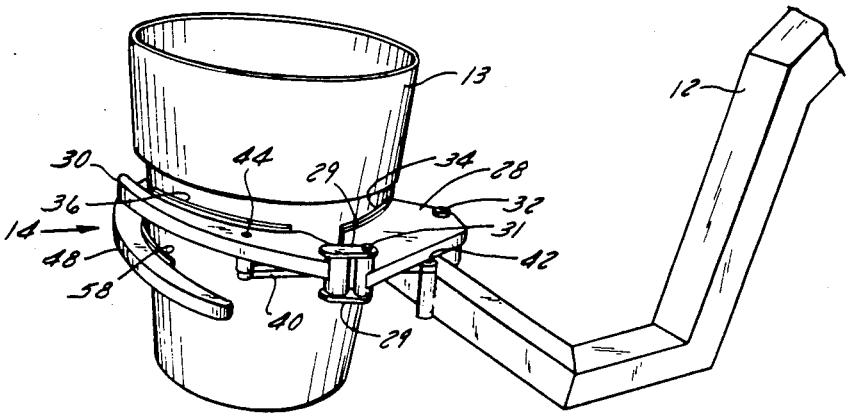
FIG. 3 is a perspective view showing the container grabbing assembly of FIG. 2 grabbing a relatively small refuse container.
Figure 4:
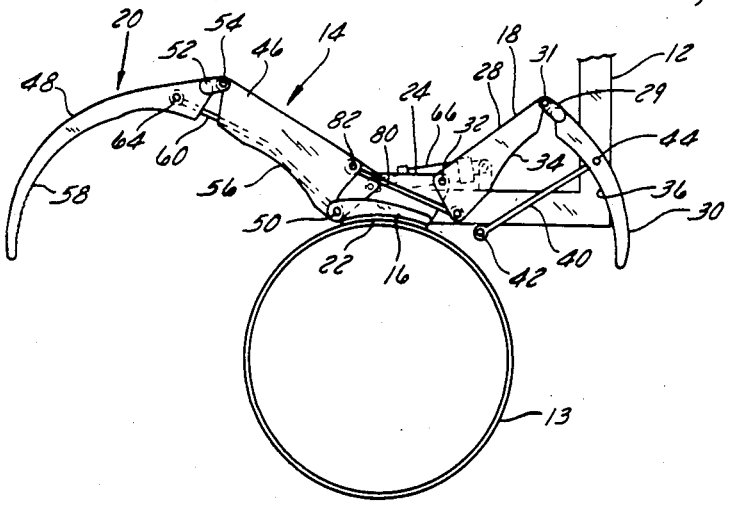
FIG. 4 is a plan view of the container grabbing assembly shown in FIGS. 2 and 3 and showing the grabbing assembly in an open relation.
Figure 5:
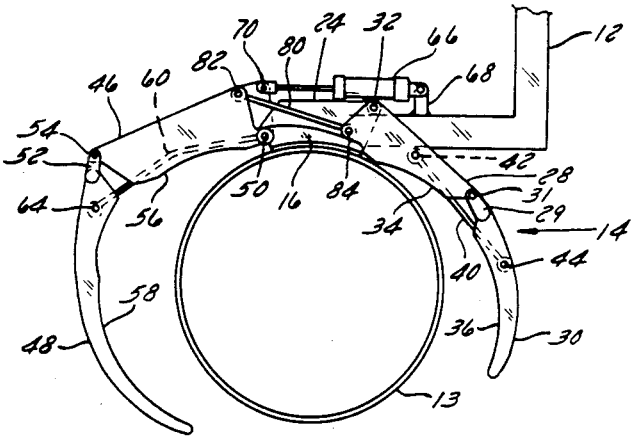
FIG. 5 is a view similar to FIG. 4 and showing the grabbing assembly approaching a container grabbing position.
Figure 6:
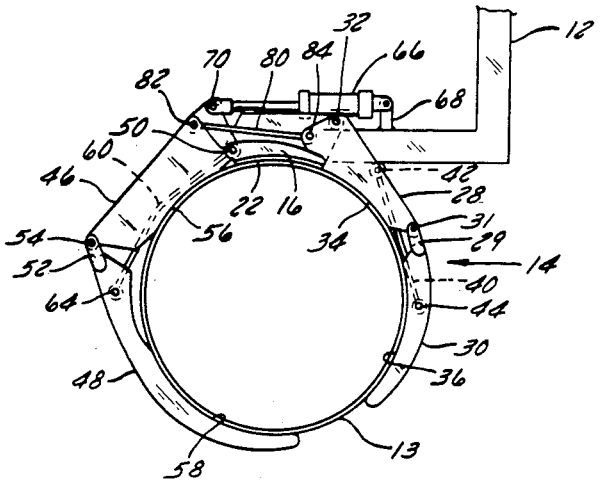
FIG. 6 is a view similar to FIGS. 4 and 5 and showing the container grabbing assembly grabbing a large container.

Referring more specifically to the grabbing assembly 14 supported by the lift frame 12, the grabbing assembly 14 is best shown in FIGS. 2–6 and comprises a base portion 16 fixed to the end of the lift frame 12 and a pair of articulated grabbing arms 18 and 20 supported by the base portion 16 for movement from a tucked or retracted position as shown in FIGS. 1, 2 and 4 to container grabbing positions shown in FIGS. 3 and 6.

While the base member 16 could be constructed in other ways, in the illustrated arrangement the base member 16 is comprised of a curved plate 22 adapted to engage the exterior surface of a portion of a container, such as container 13, to support the container. In one preferred form of the invention, the plate 22 will have a curved surface configuration conforming to the external side surface of a large container of the type to be picked up by the grabbing apparatus. The curved plate 22 is welded or otherwise fixed to the end of the lift frame 12 and is supported by one or more supporting plates 24 (FIG. 4).

One of the articulated grabbing arms 18 is comprised of a first arm section 28 and a second arm section 30 pivotally joined together. The first arm section 28 has one end pivotally joined by a pin 32 to a rearward corner of the plate 24, such that the first arm section 28 is pivotable with respect to the base member 16 and the lift frame 12 toward and away from a container 13 to be gripped. In the illustrated arrangement, the pivot pin 32 joining the first arm section 28 to the base member 16 is on one side of the base member 16 and is located rearwardly of the container supporting surface of the plate 22. This first arm section 28 also includes an opposite end or free end pivotably supporting the second arm section 30. The first arm section 28 and second arm section 30 are pivotally joined by members 29 and by a pin 31 (FIG. 3). The second arm section 30 has a length approximately the same as that of the first arm section 28. Each of the first arm section 28 and the second arm section 30 include curved container engaging surfaces 34 and 36 adapted to engage a container 13 and having a configuration generally conforming to the surface of a large container of the type to be gripped by the grabbing assembly 14.

Means are also provided for connecting the second arm section 30 to the lift frame 12 and for causing relative pivotal movement of the second arm section 30 with respect to the first arm section 28 when the first articulated arm 18 moves from the retracted position to a container grabbing position This means for connecting comprises a connecting link 40 having one end pivotally connected by a pin 42 to the lift frame 12 and an opposite end pivotally connected by a pin 44 to the second arm section 30 intermediate its opposite ends. The connecting link 40 is connected to the lift frame 12 and to the second arm section 30 such that when the first articulated arm 18 is in the retracted position (FIG. 4), the first and second arm sections 28 and 30 define a substantial angle with respect to one another. As the first articulated arm 18 moves from the retracted position shown in FIG. 4 to the position shown in FIG. 6, the connecting link 40 causes extension of the second arm section 30 such that the first and second arm sections 28 and 30 become more linear with respect to one another, and then the connecting link 40 causes movement of the second arm section around the container and then toward the base member 16 whereby the second arm section surface 36 can engage the container and pull the container toward the base member 16.

The grabbing apparatus 14 also includes a second articulated arm 20 including a first arm section 46 and a second arm section 48. The first arm section 46 of the second articulated arm 20 is pivotally connected to the base member by a hinge pin 50. The pivotal connection of the first arm section 46 to the base member 16 is closely adjacent the supporting surface portion 22 of the base member 16 and at that side of the base member opposite the first,articulated arm 18. The second arm section 48 of the second articulated arm 20 is hingedly joined to the free end of the first arm section 46 by members 52 and by a pin 54 and has a length substantially greater than that of the second arm section 30 of the first articulated arm 18. Each of the first and second arm sections 46 and 48 of the second articulated arm 20 include supporting surfaces 56 and 58 each having a curved configuration complementary to the curved configuration of the external surface of the side of a large container to be picked up by the grabbing assembly.

Means are also provided for connecting the second arm section 48 of the second articulated arm 20 to the base member 16. This means includes a second connecting link 60 having one end pivotally connected by a pin 62 to the base member 16 closely adjacent the location where the first arm section 46 is connected to the base member 16. An opposite end of the second connecting link 60 is pivotally connected by pin 64 to the second arm section 48 adjacent the pivotal connection of the second arm section 48 to the first arm section 46. The second connecting link 60 supports the second arm section 48 for movement around the container 13 and for engagement with the container to pull the container toward the base member 16.

Means are also provided for causing pivotal movement of one of the articulated arms 20 with respect to the base member 16. While various means could be provided for causing pivotal clamping movement, in the illustrated arrangement, a hydraulic cylinder 66 (FIGS. 5 and 6) has one end pivotally connected by a bracket 68 to a rearward portion of the lift frame 12 and an opposite end pivotally connected by a pin 70 to a portion of the first arm section 46 of the second articulated arm 20, this pivotal connection being rearwardly of the pivotal connection of the first arm section 46 to the base member 16. As illustrated in FIGS. 4–6, the hydraulic cylinder 66 is connected to the lift frame 12 and to the first arm section 46 of the second articulated arm 20 such that extension of the hydraulic cylinder 66 causes pivotal movement of the second articulated arm 20 around the pivot pin 50 and causes grabbing movement of the second articulated arm 20 from a retracted position shown in FIG. 4 to the grabbing position shown in FIG. 6.

Means are also provided for connecting the first arm section 28 of the first articulated arm 18 and the first arm section 46 of the second articulated arm 20 such that pivotal clamping movement of the second articulated arm 20 will cause pivotal clamping movement of the first articulated arm 18. While the means for connecting the first and second articulated arms 18 and 20 could have other constructions, in the illustrated arrangement a connecting link 80 has one end pivotally connected by a pin 82 to the first arm section 46 adjacent the connection of the hydraulic cylinder 66 to the first arm section 46. An opposite end of the connecting link 80 is pivotally connected by a pin 84 to the first arm section 28 forwardly of the pin 32 connecting the first arm section 28 to the base 16. With this connection arrangement, when the first arm section 46 of the second articulated arm 20 pivots in a counterclockwise direction as seen in FIGS. 4–6, the first arm section 28 will be caused to pivot in a clockwise direction into grabbing engagement with the container 13.

In operation of the container grabbing apparatus 14, when the first and second articulated arms 18 and 20 engage a large container 13, such as shown in FIGS. 4–6, the second arm sections 30 and 48 will extend around the container and will force the container 13 toward the base member 16 to clamp the container against the base member. If the container 13 is a smaller container as shown in FIG. 3, the articulated arms 18 and 20 will further encircle the container with the ends of the second arm sections 30 and 48 overlapping one another and with the end of one of the articulated arms positioned above the other of the articulated arms. Each of arm sections 28, 30, 46 and 48 and the base member 16 will engage the container even if the container 13 is relatively small. The container will thus be contacted at five contact areas spaced relatively uniformly around the circumference of the container, and the areas of engagement of the sections with the container will substantially conform to the surface configuration of the container.

Various features of the invention are set forth in the following claims.

We claim:

1. Apparatus for grabbing a refuse container, the apparatus comprising:

a base member, a first articulated clamp arm including a first arm section having opposite ends, one of said opposite ends of said first arm section being pivotably connected to said base member, a second arm section having opposite ends, one of said opposite ends of said second arm section being pivotally connected to the other of said opposite ends of said first arm section, a first link having opposite ends, one of said opposite ends of said first link being pivotally connected to said base member and the other of said opposite ends of said first link being pivotably connected to said second arm section intermediate its opposite ends, a second articulated arm positioned in opposed spaced relation from said first articulated arm and movable toward and away from said first articulated arm to clampingly engage a container therebetween, said second articulated arm including a first arm section having opposite ends, one of said opposite ends of said first arm section of said second articulated arm being pivotally connected to said base member, a second arm section having opposite ends, one of said opposite ends of said second arm section of said second articulated arm being pivotally connected to the other of said opposite ends of said first arm section of said second articulated arm, and a second link having opposite ends, one of said opposite ends of said second link being pivotably connected to said base member and the other of said opposite ends of said second link being pivotably connected to said second arm section of said second articulated arm intermediate its opposite ends.

2. Apparatus as set forth in claim 1 and further including means for causing movement of said first articulated arm and said second articulated arm between a retracted position and a container grabbing position, said means for causing movement including a fluid cylinder having opposite ends, one of said opposite ends being pivotally joined to said base member and the other of said opposite ends being pivotally connected to one of said first arm sections, the pivotal connection between said other of said opposite ends of said fluid cylinder and said one of said first arm sections being spaced from the pivotal connection of said one of said first arm sections and said base member.

3. Apparatus as set forth in claim 2 and further including means for connecting said first arm section of said first articulated arm to said first arm section of said second articulated arm such that movement of said first articulated arm to a container grabbing position causes movement of said second articulated arm to a container grabbing position.

4. Apparatus as set forth in claim 3 wherein said base member includes a forward surface for supporting the container, wherein said articulated arms force said container rearwardly against said base member when said articulated arms clampingly engage said container, and wherein said means for connecting said first arm section of said first articulated arm to said first arm section of said second articulated arm includes a connecting link having opposite ends, one of said opposite ends of said connecting link being connected to said first arm section of said first articulated arm rearwardly of said pivotal connection of said first arm section of said first articulated arm to said base member, and the other of said opposite ends of said connecting link being pivotably connected to said first arm section of said second articulated arm forwardly of the pivotal connection of said first arm section of said second articulated arm to said base member.

5. Apparatus as set forth in claim 1 wherein one of said first link and said second link is pivotally connected to said base member in spaced relation from the pivotal connection of said first arm section of said first articulated arm to said base and wherein the other of said connecting links is pivotally connected to said base member closely adjacent the pivotal connection of the other of said first arm sections to said base member.

6. Apparatus as set forth in claim 1 wherein said first arm section of said first articulated arm includes a first surface portion for selectively engaging a container, and wherein said second arm section of said first articulated arm includes a second surface portion for selectively engaging said container.

7. Apparatus for grabbing a solid waste refuse container and for emptying the container into a collection truck, the apparatus comprising:

a lift frame having opposite ends, one of said opposite ends being pivotally connected to the truck, and the other of said opposite ends supporting a container grabbing apparatus, said boom being supported for swingable movement such that said grabbing apparatus is movable between a lower grabbing position wherein said container grabbing apparatus can grip a solid waste refuse container and a raised dumping position wherein refuse in said solid waste refuse container is dumped into the collection truck, said container grabbing apparatus including:

a base member, a first articulated clamp arm including a first arm section having opposite ends, one of said opposite ends of said first arm section being pivotably connected to said base member, a second arm section having opposite ends, one of said opposite ends of said second arm section being pivotally connected to the other of said opposite ends of said first arm section, a first link having opposite ends, one of said opposite ends of said first link being pivotally connected to said base member, and the other of said opposite ends of said first link being pivotably connected to said second arm section intermediate its opposite ends, a second articulated arm positioned in opposed spaced relation from said first articulated arm and movable toward and away from said first articulated arm to clampingly engage a container therebetween, said second articulated arm including a first arm section having opposite ends, one of said opposite ends of said first arm section of said second articulated arm being pivotally connected to said base member, a second arm section having opposite ends, one of said opposite ends of said second arm section of said second articulated arm being pivotally connected to the other of said opposite ends of said first arm section of said second articulated arm, and a second link having opposite ends, one of said opposite ends of said second link being pivotably connected to said base member, and the other of said opposite ends of said second link being pivotably connected to said second arm section of said second articulated arm intermediate its opposite ends.

8. Apparatus as set forth in claim 7 and further including means for causing movement of said first articulated arm and said second articulated arm between a retracted position and a container grabbing position, said means for causing movement including a fluid cylinder having opposite ends, one of said opposite ends being pivotally joined to said base member and the other of said opposite ends being pivotally connected to one of said first arm sections, said pivotal connection between said other of said opposite ends of said fluid cylinder and said one of said first arm sections being spaced from the pivotal connection of said one of said first arm sections and said base member.

9. Apparatus as set forth in claim 8 and further including means for connecting said first arm section of said first articulated arm to said first arm section of said second articulated arm such that movement of said first articulated arm to a container grabbing position causes movement of said second articulated arm to a container grabbing position.

10. Apparatus as set forth in claim 9 wherein said base member includes a forward surface for supporting the container, wherein said articulated arms force said container rearwardly against said base member when said articulated arms clampingly engage said container, and wherein said means for connecting said first arm section of said first articulated arm to said first arm section of said second articulated arm includes a connecting link having opposite ends, one of said opposite ends of said connecting link being connected to said first arm section of said first articulated arm rearwardly of said pivotal connection of said first arm section of said first articulated arm to said base member, and the other of said opposite ends of said connecting link being pivotably connected to said first arm section of said second articulated arm forwardly of the pivotal connection of said first arm section of said second articulated arm to said base member.

11. Apparatus as set forth in claim 7 wherein one of said first link and said second link is pivotally connected to said base member in spaced relation from the pivotal connection of said first arm section of said first articulated arm to said base and wherein the other of said connecting links is pivotally connected to said base member closely adjacent the pivotal connection of the other of said first arm sections to said base member.

12. Apparatus as set forth in claim 7 wherein said first arm section of said first articulated arm includes a first surface portion for selectively engaging a container and wherein said second arm section of said first articulated arm includes a second surface portion for selectively engaging said container.

13. Apparatus for grabbing a refuse container, the apparatus comprising:

a base member;

a first articulated clamp arm including a first arm section, a first portion of said first arm section being pivotably connected to said base member, a second arm section having opposite ends, a first portion of said second arm section being pivotally connected to a second portion of said first arm section, a first link having opposite ends, one of said opposite ends of said first link being pivotally connected to said base member and the other of said opposite ends of said first link being pivotably connected to said second arm section intermediate its opposite ends, a second articulated arm positioned in opposed spaced relation from said first articulated arm and movable toward and away from said first articulated arm to clampingly engage a container therebetween, said second articulated arm including a first arm section, a first portion of said first arm section of said second articulated arm being pivotally connected to said base member, a second arm section having opposite ends, a first portion of said second arm section of said second articulated arm being pivotally connected to a second portion of said first arm section of said second articulated arm, a second link having opposite ends, one of said opposite ends of said second link being pivotably connected to said base member and the other of said opposite ends of said second link being pivotably connected to said second arm section of said second articulated arm intermediate its opposite ends, and means for causing movement of said first articulated arm and said second articulated arm between a retracted position and a container grabbing position, said means for causing movement including a fluid cylinder having opposite ends, one of said opposite ends of said fluid cylinder being pivotally joined to said base member and the other of said opposite ends of said fluid cylinder being pivotally connected to one of said first arm sections, the pivotal connection between said other of said opposite ends of said fluid cylinder and said one of said first arm sections being spaced from the pivotal connection of said one of said first arm sections and said base member.

14. Apparatus as set forth in claim 13 and further including means for connecting said first arm section of said first articulated arm to said first arm section of said second articulated arm such that movement of said first articulated arm to a container grabbing position causes movement of said second articulated arm to a container grabbing position.

15. Apparatus as set forth in claim 14 wherein said base member includes a forward surface for supporting the container, wherein said articulated arms force said container rearwardly against said base member when said articulated arms clampingly engage said container, and wherein said means for connecting said first arm section of said first articulated arm to said first arm section of said second articulated arm includes a connecting link having opposite ends, one of said opposite ends of said connecting link being connected to said first arm section of said first articulated arm rearwardly of said pivotal connection of said first arm section of said first articulated arm to said base member, and the other of said opposite ends of said connecting link being pivotably connected to said first arm section of said second articulated arm forwardly of the pivotal connection of said first arm section of said second articulated arm to said base member.

16. Apparatus as set forth in claim 13 wherein one of said first link and said second link is pivotally connected to said base member in spaced relation from the pivotal connection of said first arm section of said first articulated arm to said base and wherein the other of said connecting link is pivotally connected to said base member closely adjacent the pivotal connection of the other of said first arm sections to said base member.

17. Apparatus as set forth in claim 13 wherein said first arm section of said first articulated arm includes a first surface portion for selectively engaging a container, and wherein said second arm section of said first articulated arm includes a second surface portion for selectively engaging said container.

18. Apparatus for grabbing a solid waste refuse container and for emptying the container into a collection truck, the apparatus comprising:

a lift frame having opposite ends, one of said opposite ends being pivotally connected to the truck, and the other of said opposite ends supporting a container grabbing apparatus, said boom being supported for swingable movement such that said grabbing apparatus is movable between a lower grabbing position wherein said container grabbing apparatus can grip a solid waste refuse container and a raised dumping position wherein refuse in said solid waste refuse container is dumped into the collection truck, said container grabbing apparatus including:

a base member, a first articulated clamp arm including a first arm section, a first portion of said first arm section being pivotably connected to said base member, a second arm section having opposite ends, a first portion of said second arm section being pivotally connected to a second portion of said first arm section, said first articulated clamp arm being movable inwardly toward a container gripping position and outwardly to a container release position, a first link having opposite ends, one of said opposite ends of said first link being pivotally connected to said base member, and the other of said opposite ends of said first link being pivotably connected to said second arm section intermediate its opposite ends, and said first link being inwardly of the pivotal connection of said first arm section and said second arm section, a second articulated arm positioned in opposed spaced relation from said first articulated arm and movable inwardly toward said first articulated arm to clampingly engage a container therebetween and outwardly away from the first articulated arm to release the container, said second articulated arm including a first arm section, a first portion of said first arm section of said second articulated arm being pivotally connected to said base member, a second arm section having opposite ends, a first portion of said second arm section of said second articulated arm being pivotally connected to a second portion of said first arm section of said second articulated arm, and a second link having opposite ends, one of said opposite ends of said second link being pivotably connected to said base member and the other of said opposite ends of said second link being pivotably connected to said second arm section of said second articulated arm intermediate its opposite ends, said second link being inwardly of the pivotal connection of said first arm section and said second arm section of said second articulated arm.

19. Apparatus as set forth in claim 18 and further including means for causing movement of said first articulated arm and said second articulated arm between a retracted position and a container grabbing position, said means for causing movement including a fluid cylinder having opposite ends, one of said opposite ends of said fluid cylinder being pivotally joined to said base member and the other of said opposite ends of said fluid cylinder being pivotally connected to one of said first arm sections, said pivotal connection between said other of said opposite ends of said fluid cylinder and said one of said first arm sections being spaced from the pivotal connection of said one of said first arm sections and said base member.

20. Apparatus as set forth in claim 19 and further including means for connecting said first arm section of said first articulated arm to said first arm section of said second articulated arm such that movement of said first articulated arm to a container grabbing position causes movement of said second articulated arm to a container grabbing position.

21. Apparatus as set forth in claim 20 wherein said base member includes a forward surface for supporting the container, wherein said articulated arms force said container rearwardly against said base member when said articulated arms clampingly engage said container, and wherein said means for connecting said first arm section of said first articulated arm to said first arm section of said second articulated arm includes a connecting link having opposite ends, one of said opposite ends of said connecting link being connected to said first arm section of said first articulated arm rearwardly of said pivotal connection of said first arm section of said first articulated arm to said base member, and the other of said opposite ends of said connecting link being pivotably connected to said first arm section of said second articulated arm forwardly of the pivotal connection of said first arm section of said second articulated arm to said base member.

22. Apparatus as set forth in claim 18 wherein one of said first link and said second link is pivotally connected to said base member in spaced relation from the pivotal connection of said first arm section of said first articulated arm to said base member and wherein the other of said connecting links is pivotally connected to said base member closely adjacent the pivotal connection of the other of said first arm sections to said base member.

23. Apparatus as set forth in claim 18 wherein said first arm section of said first articulated arm includes a first surface portion for selectively engaging a container and wherein said second arm section of said first articulated arm includes a second surface portion for selectively engaging said container.

* * * * *